US005992603A

United States Patent [19]

Sears

[11] Patent Number: 5,992,603

[45] Date of Patent: Nov. 30, 1999

[54] COIN ACCEPTANCE MECHANISM AND METHOD OF DETERMINING AN ACCEPTABLE COIN

[75] Inventor: Lawrence M. Sears, Hunting Valley, Ohio

[73] Assignee: Ginsan Industries Inc, Grand Rapids, Mich.

[21] Appl. No.: 08/993,995

[22] Filed: Dec. 18, 1997

[51] Int. Cl.[6] ..... G07D 5/08

[52] U.S. Cl. ..... 194/318

[58] Field of Search ..... 194/318, 317, 194/319, 200, 202, 203

[56] References Cited

U.S. PATENT DOCUMENTS

| | | | |
|---|---|---|---|
| 4,086,527 | 4/1978 | Cadot . | |
| 4,884,672 | 12/1989 | Parker . | |
| 4,936,435 | 6/1990 | Griner | 194/317 |
| 4,946,019 | 8/1990 | Yamashita . | |
| 4,998,610 | 3/1991 | Said et al. . | |
| 5,048,662 | 9/1991 | Yamashia et al. . | |
| 5,056,644 | 10/1991 | Parker . | |
| 5,067,604 | 11/1991 | Metcalf | 194/203 |
| 5,078,252 | 1/1992 | Furuya et al. . | |
| 5,097,934 | 3/1992 | Quinlan, Jr. . | |
| 5,131,518 | 7/1992 | Shimizu | 194/318 |
| 5,167,313 | 12/1992 | Dobbins et al. . | |
| 5,184,709 | 2/1993 | Nishiumi et al. | 194/318 |
| 5,191,956 | 3/1993 | Ibarrola . | |
| 5,197,957 | 3/1993 | Hayes | 194/318 |
| 5,207,307 | 5/1993 | Waite . | |
| 5,213,190 | 5/1993 | Furneaux et al. . | |
| 5,236,071 | 8/1993 | Lee . | |
| 5,248,023 | 9/1993 | Vidondo . | |
| 5,263,566 | 11/1993 | Nara et al. . | |
| 5,293,979 | 3/1994 | Levasseur . | |
| 5,293,980 | 3/1994 | Parker . | |
| 5,316,119 | 5/1994 | Sugimoto et al. . | |
| 5,323,891 | 6/1994 | Waite . | |
| 5,330,041 | 7/1994 | Dobbins et al. | 194/206 |
| 5,337,877 | 8/1994 | Waite et al. . | |
| 5,341,908 | 8/1994 | Furneaux | 194/317 |
| 5,351,798 | 10/1994 | Hayes | 194/318 |
| 5,476,168 | 12/1995 | Malzard et al. | 194/203 |

FOREIGN PATENT DOCUMENTS

| | | | |
|---|---|---|---|
| 2 234 619 | 6/1991 | United Kingdom | 194/317 |

*Primary Examiner*—Robert P. Olszewski
*Assistant Examiner*—Bryan Jaketic

[57] ABSTRACT

A coin acceptance mechanism and a method of determining an acceptable coin includes a pair of spaced apart coils between which a coin is passed. A signal is generated in one of the coils and induced in the other coil when a coin passes between the coils. The peak amplitude of the signal induced in the other coil and the peak phase difference between the signals in the pair of coils are both compared to a range of acceptable values stored in a memory to determine if a coin is acceptable and to assign a value to the coin deemed acceptable. The coin acceptance mechanism has a program mode in which it can be programmed to recognize coins of various values and coins or tokens from various countries.

19 Claims, 3 Drawing Sheets

103
106
112
55
120
116
114
56
144
142
146
145
62
64
50
MICRO-
PROCESSOR
+5V
+30V
156
66
38
24
158
+5V
+5V
52
MEMORY

COIN ACCEPTANCE MECHANISM AND METHOD OF DETERMINING AN ACCEPTABLE COIN

DESCRIPTION—TECHNICAL FIELD

The present invention relates to a coin acceptance mechanism and a method of determining whether a coin is acceptable and more particularly to a method and coin acceptance mechanism which utilizes a pair of spaced apart coils and wherein a signal is established in one of the coils and induced in the other of the coils which signal changes in phase and amplitude when a coin passes between the pair of spaced apart coils.

BACKGROUND OF THE INTENTION AND REFERENCE TO RELATED PATENTS

Some known coin acceptance mechanisms include means for sensing the phase change of a signal established in a first coil and induced in a second spaced apart coil when a coin passes between the pair of coils. Others include means for sensing the change in amplitude of a signal established in a first coil and induced in a second coil when a coin passes between the pair of coils. Examples of such devices are disclosed in U.S. Pat. No. 4,998,610, U.S. Pat. No. 5,056,644, and U.S. Pat. No. 5,097,934.

It is desirable to be able to readily change the criteria for determining an acceptable coin to enable the coin acceptance mechanism to work with coins of various national governments and coins or tokens of various denominations. The size and metallurgical content of Canadian coins differs from that of United States coins and differs from that of Australian coins. Hence, it is desirable to have a coin mechanism in which the criteria for determining whether a coin or token is acceptable can be varied to accommodate coins of various nationalities, values, size and metallurgical content.

The present invention overcomes the disadvantages associated with the prior art by providing a coin acceptance mechanism which can be programmed to determine a range of acceptable values for criteria associated with acceptable coins of various nationalities and values.

SUMMARY OF THE INVENTION

The present invention provides a new and improved coin acceptance mechanism which includes a coin receiving chute having a pair of sides between which coins are adapted to pass, first and second spaced apart coils located on opposite sides of the coin chute and a signal generator for generating a first electrical signal and directing the first signal to the first coil. The first coil induces a second signal in the second coil which changes in phase and amplitude when a coin passes between the first and second coils. The coin acceptance mechanism includes means for determining the phase difference between the first and second signals when a coin passes between the first and second coils and establishing a third signal indicative of the phase difference, means for determining the peak amplitude of the second signal when a coin passes between the first and second coils and generating a fourth signal indicative of the peak amplitude of the second signal, memory means for storing a range of acceptable values for the peak phase difference between the first and second signals and the peak amplitude of the second signal which are indicative of an acceptable coin, and microprocessor means for receiving the third signal and fourth signal determining the peak phase difference between said first and second signals and the peak amplitude of the second signal. The microprocessor is connected to the memory means for comparing the third and fourth signals with the range of acceptable values in the memory means to determine whether a coin passing between the coils is an acceptable coin and for assigning a credit value for coins which are determined to be acceptable. The microprocessor has a learning mode in which a plurality of sample acceptable coins of a single value are sequentially placed in the coin chute and the third and fourth signals generated by the plurality of sample acceptable coins are averaged to determine an acceptable range of values for each of the third and fourth signals which represent an acceptable coin of the single value. The microprocessor stores the determined acceptable range of values in the memory means.

A further provision of the present invention is to provide a new and improved method of determining whether a coin which passes between a pair of coils in a coin acceptance mechanism is an acceptable coin and assigning an acceptable range of values to coins deemed acceptable including the steps of: providing a pair of spaced apart coils through which coins must pass, establishing a first electrical signal in one of the coils which induces a second signal in the other of the coils, passing a plurality of sample acceptable coins of a first value between the pair of coils, determining the phase difference between the first electrical signal and the second electrical signal when each of the plurality of sample acceptable coins passes between the pair of coils, determining the peak amplitude of the second electrical signal when each of the plurality of sample acceptable coins passes between the pair of coils, determining the average peak phase difference between the first and second electrical signals and the average peak amplitude of the second electrical signal for the plurality of acceptable sample coins, using the determined average peak phase difference and the determined average peak amplitude to determine a range of acceptable values for the peak phase difference between the first and second signals and the peak amplitude of the second signal when acceptable coins of the first value are passed between the pair of spaced apart coils, passing a coin between the coils, determining the peak phase difference between the first and second signals when the coin passes between the pair of coils, determining the peak amplitude of the second signal when the coin passes between the pair of coils, and comparing the determined peak phase difference between the first and second signals and the determined peak amplitude of the second signal with the range of acceptable values to determine if the coin passing between the pair of coils is an acceptable coin and for assigning a value to a coin deemed acceptable.

DESCRIPTION OF THE INVENTION

Figure 4A:
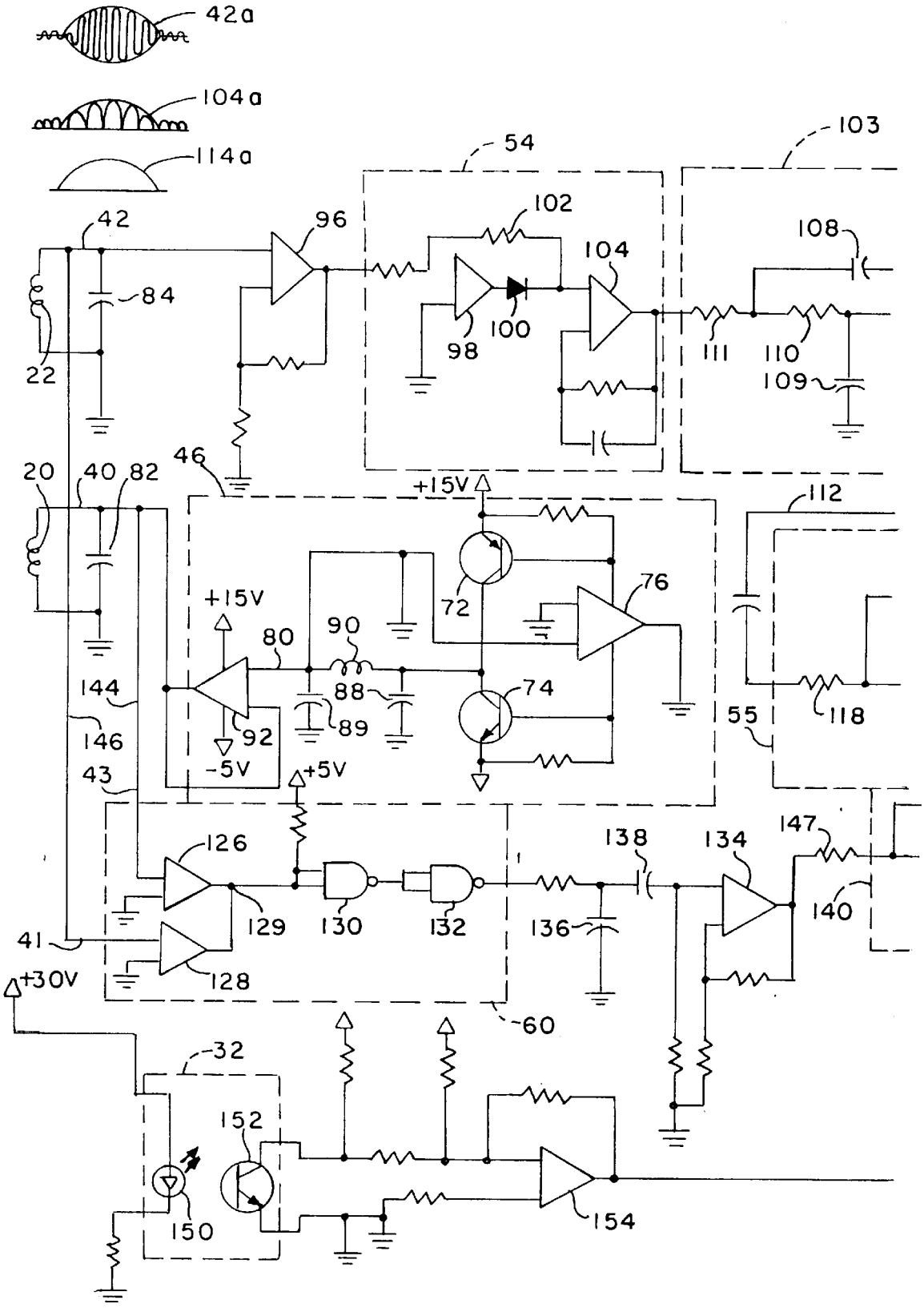
Figure 4B:
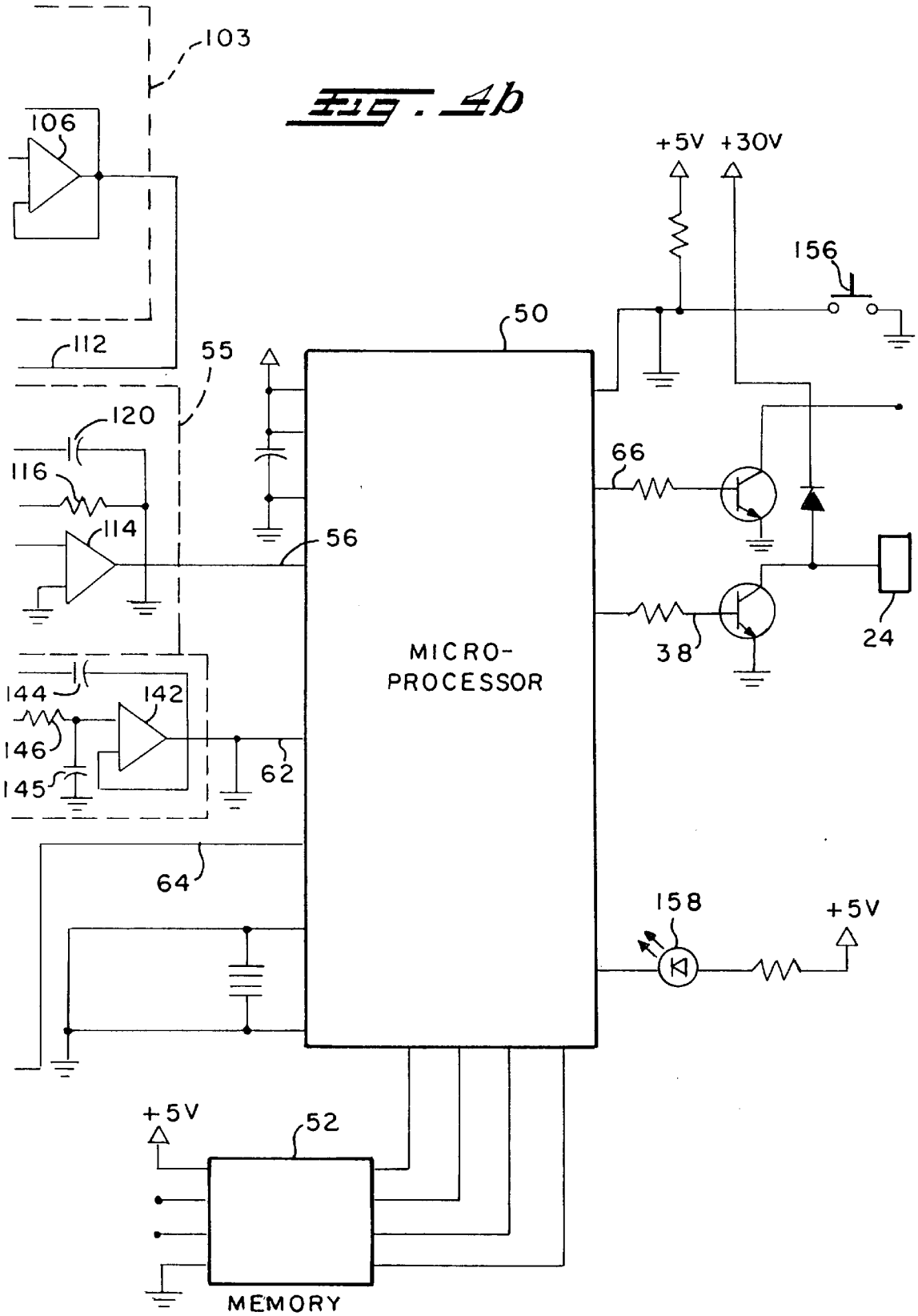

FIG. 4*a* and FIG. 4*b* are a circuit diagram of the preferred embodiment more fully illustrating the electrical circuitry of the coin acceptance mechanism.

DESCRIPTION OF THE PREFERRED EMBODIMENT

Figure 1:
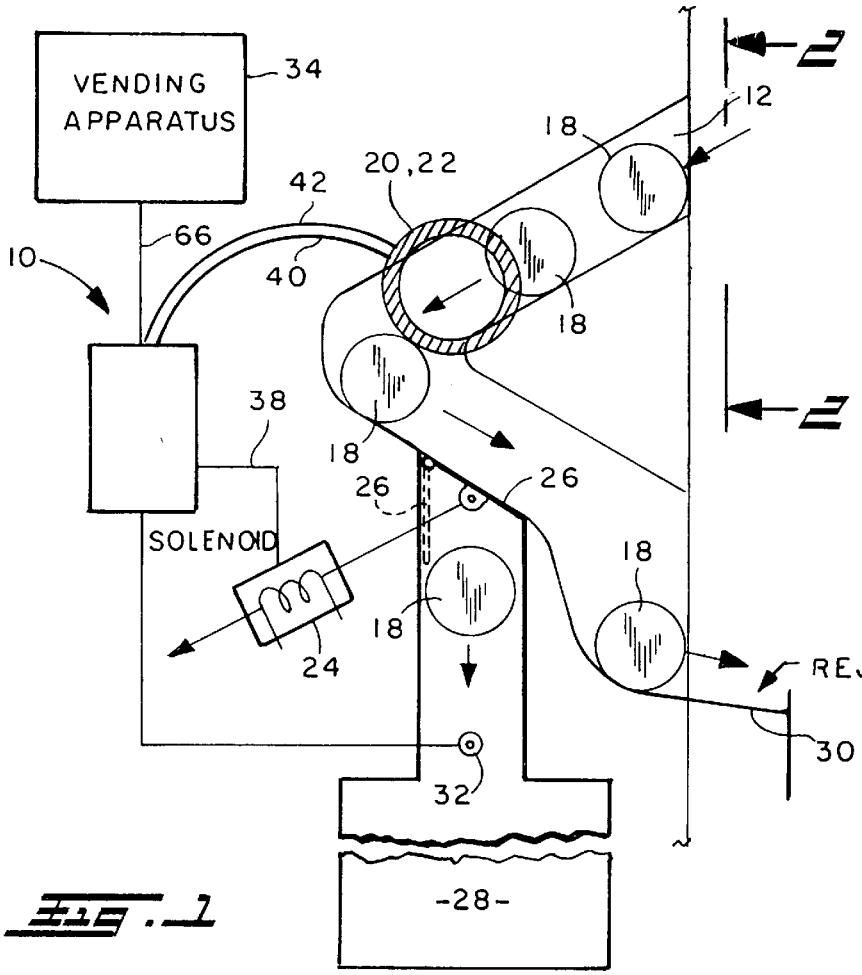
FIG. 1 is a schematic illustration of the coin acceptance mechanism of the present invention.
Figure 2:
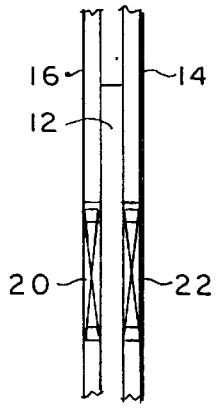
FIG. 2 is a side view of the coin acceptance mechanism taken approximately along the lines 2—2 of FIG. 1 illustrating the sensing coils disposed on opposite sides of the coin chute.

Referring to the Figures, and more particularly to FIGS. 1 and 2, a coin acceptance mechanism 10 is illustrated. The coin acceptance mechanism 10 is associated with a coin chute 12 having pair of side walls 14, 16 between which a coin 18 is adapted to pass. A pair of spaced apart coils 20, 22 are mounted on the side walls 14, 16 of the coin chute with the coil 20 disposed on side wall 16 and the coil 22 disposed on side wall 14. The coils 20, 22 are disposed on the side walls 14, 16 of the coin chute 12 so that any coin passing through the coin chute 12 must pass between the spaced apart coils 20, 22. It should be realized that although the coils 20,22 are described as being mounted "on" side walls 14, 16, the coils could be mounted in or behind side walls 14, 16 depending on the construction of side walls 14, 16. The coils 20, 22 are energized by the coin acceptance mechanism 10 as will be discussed more fully hereinafter.

A solenoid 24 is connected to an output 38 of the coin acceptance mechanism 10 and is adapted to be energized to direct coins passing through the coin chute 12 to a coin box 28 or a coin return chute 30. An arm or door 26 is connected to the solenoid 24 to direct coins which are deemed acceptable to the coin box 28 and coins which are deemed unacceptable to the coin return chute 30. When solenoid 24 is energized door 26 is moved to its phantom line position, illustrated in FIG. 1, and coins passing through coin chute 12 drop into coin box 28. When solenoid 24 is not energized the door 26 is "closed" and coins in chute 12 pass to the coin return chute 30. A sensor 32 is connected to the coin acceptance mechanism 10 for establishing a coin received signal when an acceptable coin passes from the coin chute 12 into the coin box 28. The coin acceptance mechanism 10 is adapted to direct a signal to a vending apparatus 34 when an acceptable coin activates sensor 32 and passes into the coin box 28. The coin acceptance mechanism 10 establishes the signal to the vending apparatus 34 which is indicative of the value of the acceptable coin which passes into the coin box 28. The vending apparatus 34 can be one of several known vending apparatus for vending bottles, fluid or snacks. In the preferred embodiment, the vending apparatus 34 is a manually operated car wash and the vending apparatus 34 controls the wash time or items to be dispensed.

Figure 3:
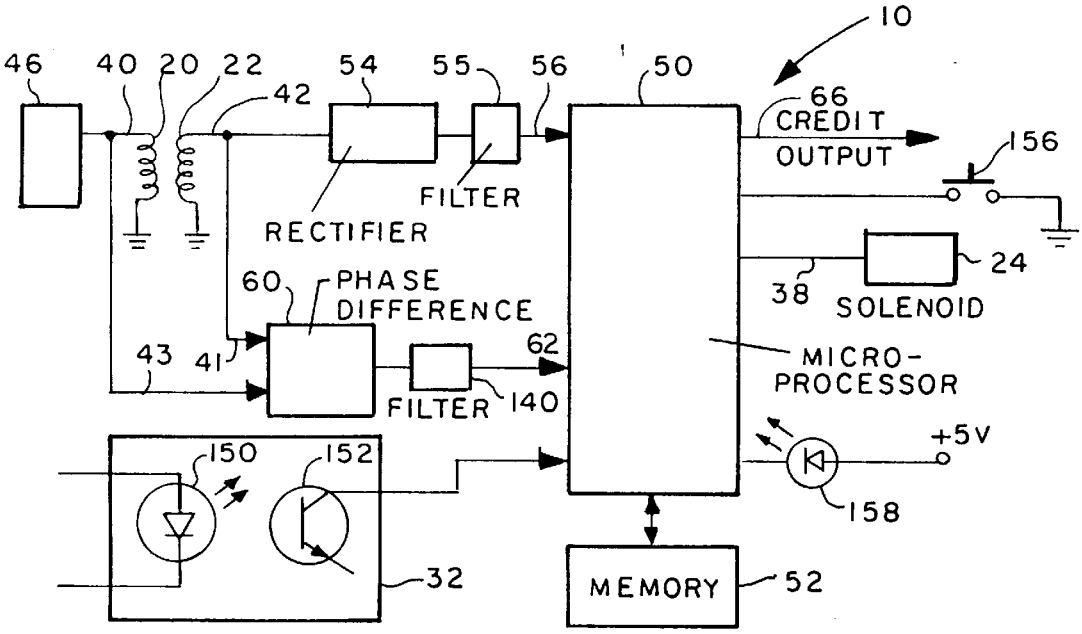
FIG. 3 is a electrical block diagram of the circuitry associated with the present invention.

The coin acceptance mechanism 10, more fully illustrated in FIG. 3, includes a signal generator 46 which generates a first electrical signal which is directed along conductor 40 to the coil 20. The first signal in coil 20 induces a second signal in coil 22 which is spaced apart from coil 20 in a well-known manner. When a coin passes between coils 20 and 22, the second signal induced in coil 22 by the first signal in coil 20, changes in both phase and amplitude dependent upon the size of the coin 18 and the metallurgical content of the coin. The coin acceptance mechanism 10 utilizes the sensed phase difference between the signals in coils 20 and 22 and the amplitude of the signal induced in coil 22 to determine whether a coin which passes between the coils 20, 22 is an acceptable or unacceptable coin.

The coin acceptance mechanism 10 includes a microprocessor 50 and a non-volatile memory 52 which is connected to the microprocessor 50. The memory 52 includes information stored therein which is indicative of ranges of acceptable values for the peak phase difference between the signal in the coil 20 and the signal in coil 22 and acceptable ranges for the peak amplitude of the second signal induced in coil 22 when an acceptable coin passes between the coils 20 and 22.

The output of coil 22 is directed along line 42 through a rectifier 54 and filter circuit 55 to the analog input 56 of the microprocessor 50. The input on line 56 to microprocessor 50 is a fourth signal which is an analog voltage indicative of the amplitude of the second electrical signal induced in coil 22 when a coin passes between the spaced apart coils 20, 22. The microprocessor 50 receives the fourth signal and determines the peak amplitude of the second electrical signal. The output of coil 22 is also directed along line 42 to an input 41 of phase difference circuit 60. An output from the first coil 20 is directed along line 40 to an analog input 43 of the phase difference circuit 60. The phase difference circuit 60 is operable to direct a third signal through a filter circuit 140 to the input 62 of the microprocessor 50 which is an analog voltage indicative of the phase difference between the signals in coil 20 and coil 22 when a coin passes between the coils. The microprocessor 50 receives the third signal and determines the peak phase difference between the signals in coils 20 and 22.

When a coin passes between coils 20, 22, the microprocessor 50 receives the fourth signal on analog input 56 which is indicative of the peak amplitude of the second signal in coil 22 and the third signal at input 62 which is indicative of the phase difference between the first and second signals in coils 20 and 22 when a coin passes between the coils 20 and 22. The microprocessor 50 determines the peak phase difference between the first and second signals and the peak amplitude of the second signal and compares the signals on lines 56 and 62 with the information stored in the memory means 52 to determine if the coin passing between the coils 20 and 22 is an acceptable coin or an unacceptable coin. If a coin is deemed an acceptable coin, i.e., the peak phase difference between the first and second signals and the peak amplitude of the second signal are both within the range of acceptable values in memory means 52, the microprocessor 50 energizes solenoid 24 to move arm 26 into its phantom line position illustrated in FIG. 1 to direct the acceptable coin passing through the coin chute 12 to the coin box 28. If a coin is not acceptable, the solenoid 24 is not energized and the arm 26 remains in its full line position illustrated in FIG. 1 in which coins are directed to the coin return chute 30. If a coin is deemed acceptable and is directed to the coin box 28, the coin passes sensor 32 which establishes a signal on the input 64 of the microprocessor 50. Upon receipt of the signal at input 64 from sensor 32, the microprocessor 50 establishes a credit output on line 66 to a vending apparatus 34 indicative of receipt of an acceptable coin and the value of the acceptable coin.

The range of acceptable values stored in the non-volatile memory 52 can preferably be a plurality of ranges of acceptable values wherein each range is indicative of an acceptable range for a coin of a predetermined value. For example, if quarters are directed through the coin chute 12, the acceptable ranges for the peak amplitude of the induced second signal in coil 22 and the peak phase difference between the first and second signals in coils 20 and 22 will be a first set of acceptable ranges. If the acceptable coin is a dime, the acceptable ranges stored in memory 52 will include a second acceptable range of the peak amplitude of the second signal induced in coil 22 and a second acceptable range for the peak phase difference between the first and second signals in coil 20 and coil 22. The peak amplitude of the second signal induced in coil 22 and the peak phase difference between the signals in coils 20 and 22 is sufficiently different for coins of different values due to the size and metal content of the various coins so that accurate distinct acceptable ranges can be set in the memory means 52.

The coin acceptance mechanism 10 includes a learning mode wherein sample acceptable coins of a single first predetermined value are sequentially placed in the coin chute 12 and the peak amplitude of the second signal induced in coil 22 and the peak phase difference between the signals in coils 20 and 22 is recorded for each of the sample acceptable coins of a predetermined value by the microprocessor 50. The microprocessor 50 then calculates the average peak amplitude for the second signal induced in coil 22 and the average peak phase difference between the signals in coils 20 and 22 for the signals generated when the sample acceptable coins of a single first value are passed through the coin acceptance mechanism 10. The average value of the peak amplitude of the second signal induced in coil 22 and the average value of the peak phase difference between the signals in coil 20 and 22 for the sample acceptable coins is then utilized to establish in the microprocessor 50 a range of acceptable values for the peak amplitude and peak phase difference associated with acceptable coins. The range of calculated acceptable values for the amplitude and phase difference is then stored by the microprocessor 50 in the memory 52.

The range of acceptable values can be calculated by the microprocessor 50 using two methods. In the first method, the microprocessor takes the average value of the peak amplitude of the second signal at coil 22 and the average value of the peak phase difference between the signals in coil 20 and 22 and adds a fixed predetermined plus and minus value to each of the determined average values to determine a range of acceptable values for the peak amplitude and peak phase difference of an acceptable coin. In the second method, the microprocessor 50 determines an acceptable percentage deviation, plus or minus, from the determined average value of the peak amplitude of the signal in coil 22 and the peak phase difference between the signals in coil 20 and 22 to determine a range of acceptable values for the peak amplitude and peak phase difference associated with acceptable coins of a predetermined value.

It should be appreciated that the microprocessor 50 can set a plurality of ranges of acceptable values which are indicative of the acceptable ranges for the signals of a plurality of acceptable coins having different values. For example, a first range of values can be stored in memory 52 indicative of the acceptable range of the peak amplitude determined at coil 22 for the second signal and the peak phase difference sensed between coils 20 and 22 which is indicative of the acceptable range of values for quarters, and a second range of acceptable ranges could be stored in memory 52 which is indicative of an acceptable coin of a different value, for example, a dime, passing between coils 20 and 22.

Referring more particularly to FIGS. 4*a* and *b*, the circuitry of the coin acceptance mechanism 10 is illustrated in more detail. The signal generator 46, includes an L.C. oscillator formed by transistors 72, 74, amplifier 76, inductor 90 and capacitors 88 and 89 which establishes an output on line 80 which is directed through an amplifier 92 to the coil 20 to establish the first signal in coil 20. Capacitor 82 is connected across coil 20 and capacitor 84 is connected across coil 22. The capacitors 82,84 establish a resonant circuit with coils 20,22 to provide a clean sinusoidal signal across both coils 20,22. Coil 20 induces the second electrical signal in coil 22 which is directed along line 42 to the rectifier circuit 54 which includes amplifiers 98 and 104 and their associated electrical components. The output of coil 20 is normally quiescent, i.e. a sinusoidal wave having a relatively small amplitude is established in coil 22, but when a coin 18 passes between coils 20,22 an increase in the sinusoidal amplitude, schematically illustrated at 42*a*, is established in coil 22 which is sensed by the coin acceptance mechanism. The peak value of the amplitude at the output of coil 22 is recorded and the phase difference between the sinusoidal signals in coils 20 and 22 is sensed. Line 42 is connected to the input of an amplifier 96 whose output is directed through a rectifier circuit 54 including amplifier 98, diode 100 and resister 102 which are connected to the input of amplifier 104. The rectifier circuit 54 rectifies the output of the coil 22 and establishes the rectified wave form schematically illustrated at 104*a*, at the output of the amplifier 104. Amplifier 104 directs the rectified signal through filter circuitry 103 including amplifier 106, capacitors 108 and 109 and resisters 110 and 111, along line 112 to another amplifier circuit 55 which includes amplifier 114, resisters 116 and 118 and capacitor 120. The output from the amplifier 114, schematically illustrated at 114*a*, is a pulse which represents the envelope of the rectified sinusoidal signal established in coil 22 by the passage of the coin between coils 20,22. The pulse is directed to the analog input 56 of microprocessor 50 and is an analog signal indicative of the amplitude of the envelope of the second signal induced in coil 22 when a coin of a predetermined value passes between coils 20 and 22. Microprocessor 50 records the peak value of the pulse at analog input 56.

The phase difference circuit 60 includes a pair of comparators 126 and 128 whose outputs are summed at 129 and directed through gates 130, 132, connected as inverters, to buffer the output signal. The comparator 126 has an input 43 connected via line 144 to line 40 which is connected to the first coil 20 and establishes a signal which is indicative of the signal in the coil 20 at the input to comparator 126. An input 41 to the comparator 128 is connected via line 146 to line 42 which is connected to coil 22 and establishes a signal which is indicative of the signal in coil 22 at the input of comparator 128. The outputs of the comparators 126 and 128 are connected together at 129 and establish a rectangular pulse having a width or duration which is representative of the phase difference between the signal in coil 20 and the signal induced in coil 22. The output of comparators 126,128 are directed through buffer gates 130 and 132 to a filter circuit including capacitors 136 and 138 and an amplifier 134. The output of amplifier 134 is connected through a filter circuit 140 including amplifier 142, capacitors 144 and 145 and resistors 146 and 147 to the analog input 62 of the microprocessor 50. The input at terminal 62 is the third signal which is an analog signal indicative of the phase difference between the first signal in coil 20 and the second signal induced in coil 22.

The sensor 32 in the preferred embodiment as is illustrated in FIG. 4*a*, includes a light-emitting diode 150 which is coupled to a photo-receptive transistor 152. The sensor 132 is located in a position in which a coin 18 which passes into coin box 28 will pass between the light-emitting diode 150 and the photo-receptive transistor 152, breaking the stream of radiation in a well-known manner and initiating an output signal from the photo-transistor 152 which is directed to an amplifier 154. The output of amplifier 154 is directed to the digital input terminal 64 of microprocessor 50. Sensor 32 is thus operable to establish a signal at the input 64 of microprocessor 50 which indicates receipt of a coin from the coin chute 12 to the coin box 28. Sensor 32 prevents tampering and insures that a coin is received in the coin box 28.

When a coin 18 is received in the coin chute 12, it passes between coils 20 and 22 and the amplitude of the second signal induced in coil 22 is sensed and a fourth signal is established at the analog input 56 of the microprocessor 50 indicative of the peak amplitude of the second signal induced in coil 22. The phase of the signals in coil 20 and coil 22 are compared in the phase difference circuit 60 and a third signal indicative of the phase difference between the signal in coil 20 and the signal in coil 22 is established at analog input 62 of the microprocessor 50. The microprocessor 50 then compares the peak of the fourth signal at input 56 and the peak of the third signal at input 62 with the range of acceptable values stored in memory 52 which preferably is a non-volatile memory. If the fourth signal at input 56, indicative of the peak amplitude of the second signal in coil 22, and the signal at input 62, indicative of the peak phase difference, are both within the acceptable range within memory 52, the microprocessor 50 will determine that the coin passing between the coils 20 and 22 is an acceptable coin and the solenoid 24 will be momentarily energized by microprocessor 50 to move arm 26 to its phantom line position illustrated in FIG. 1 to direct the coin deemed acceptable to the coin box 28. When the coin passes sensor 32 on its way to the coin box 28, sensor 32 will signal microprocessor 50 at digital input 64 and the microprocessor will establish a credit output on terminal 66. Preferably the credit output can be in the form of a series of pulses which are indicative of the value of the coin which has been deemed acceptable and passed to the coin box 28. For example, if a quarter is sensed, five pulses can be generated and if a dime is sensed two pulses can be generated. However, other types of coded signals could be generated and still come within the scope of the present invention.

The microprocessor 50 can be programmed to program memory 52 with a plurality of acceptable ranges for the amplitude of the signal in coil 22 and the phase difference between the signals in coil 20 and 22 when coins of an acceptable value are received in the coin chute 12. To program the microprocessor a button 156 is pushed to put the microprocessor 50 in its program mode. A LED 158 lights to indicate the microprocessor 50 is in its program mode. The operator then sequentially feeds 15 sample acceptable coins of a single value one by one through the coin chute 12 and the microprocessor 50 measures and records the phase difference and peak amplitude of each of signals generated by the sample coins. After 15 coins are dropped into the chute 12 the programming is complete, LED 158 turns off, and the microprocessor determines the average peak amplitude value and the average peak phase difference and establishes a range of acceptable values for the peak amplitude and peak phase difference which is stored in the memory 51. While the programming mode has been disclosed as using 15 sample coins, more or less sample coins could be used without departing from the scope of the present invention.

When the microprocessor is placed in its program mode, a plurality of sample acceptable coins of a single value can be sequentially dropped into the coin chute 12 and sequentially pass between coils 20 and 22. As each sample acceptable coin passes between the coils 20 and 22, the peak amplitude of the second signal induced in coil 22 and the peak phase difference between the first and second signals in coils 20 and 22 are determined and stored in the microprocessor 50. The microprocessor 50 then averages the peak signals received from the sample acceptable coins to determine an average peak amplitude and an average peak phase difference value. The microprocessor then determines an acceptable range for the peak amplitude and the peak phase difference using the determined average peak amplitude and peak phase difference. The microprocessor 50 then downloads the determined acceptable range of values for the peak amplitude and peak phase difference into the memory 52. The program mode is repeated using a plurality of sample acceptable coins of a different value. In this manner, the coin acceptance mechanism 10 can be programmed to accept nickels, dimes, quarters, etc. in United States currency and coins or tokens of various denominations in other currencies such as Canadian coins, Australian coins, Mexican coins, etc. The coin acceptance mechanism 10 is operable to determine whether the coins which pass between coils 20 and 22 are acceptable coins and to set a range of values for coins deemed acceptable. The microprocessor 50, when comparing the received peak amplitude and peak phase difference signals with the range of acceptable values stored in the memory 52, also determines which of the plurality of ranges stored in memory 52 in which the received signals fit to enable the microprocessor 50 to determine the value of a coin deemed acceptable.

From the foregoing, it should be apparent that a new and improved coin acceptance mechanism 10 has been disclosed. The coin acceptance mechanism includes a coin receiving chute 12 having a pair of sides 14, 16 between which coins 18 are adapted to pass. First and second spaced apart coils 20, 22 are located on opposite sides of the coin chute 12 in a location in which a coin 18 received in the chute 12 passes between the first and second spaced apart coils 20, 22. A signal generator 46 is provided for generating a first electrical signal and directing the first signal to the first coil 20. The first coil 20 induces a second signal in the second coil 22 which signal changes in phase and amplitude when a coin passes between the first and second coils 20, 22. A phase difference circuit 60 is provided for measuring the phase difference between the first and second signals when a coin passes between the first and second coils 20, 22 and generates a third signal at input 62 indicative of the phase difference. Means are provided for measuring the peak amplitude of the second signal induced in coil 22 and generating a fourth signal at terminal 56 which is indicative of the peak amplitude of the second signal. A memory 52 is provided having stored therein a range of acceptable values for the peak phase difference between the first and second signals and the amplitude of the second signal which are indicative of an acceptable coin passing between the first and second coils 20, 22. A microprocessor 50 is provided for receiving the third signal at input 62 and the fourth signal at input 56 and connected to the memory means 52 for comparing the third and fourth signals with the range of acceptable values in the memory 52 to determined if a coin passing between the coils 20, 22 is an acceptable coin and for assigning a credit value for coins which are deemed to be acceptable. The microprocessor 50 has a learning mode in which sample acceptable coins can be used to program the range of acceptable values in the memory means 52.

In addition, a method has been disclosed for determining whether a coin which passes between a pair of coils 20, 22 in a coin acceptance mechanism 10 is an acceptable coin and assigning a value to a coin which is deemed acceptable including the steps of: a) providing a pair of spaced apart coils 20, 22 between which coins 18 must pass when received in the coin acceptance mechanism 10; b) establishing a first electrical signal with signal generator 46 in coil 20 which induces a second electrical signal in coil 22 which second signal changes in phase and amplitude when a coin passes between the pair of spaced apart coils 20 and 22; c) sequentially passing a plurality of sample acceptable coins of a single value between the pair of coils 20, 22 in the coin acceptance mechanism 10; d) determining the phase difference with phase difference circuit 60 between the first electrical signal in coil 20 and the second electrical signal induced in coil 22 when each of the plurality of sample acceptable coins passes between the pair of coils 20, 22; e) determining the amplitude of the second electrical signal in the coil 22 when each of the plurality of sample acceptable coins passes between the pair of coils 20, 22; f) determining in the microprocessor 50 the average peak phase difference between the first and second electrical signals for the plurality of sample acceptable coins and the average peak amplitude of the second electrical signal for the plurality of sample acceptable coins; g) using in the microprocessor 50 the determined average peak phase difference to set in the memory means 52 a range of acceptable values for the peak phase difference between the first and second signals when acceptable coins of the single value are passed between the pair of spaced apart coils 20, 22; and h) using in the microprocessor 50 the determined average peak amplitude of the second electrical signal to set in the memory means 52 a range of acceptable values for the peak amplitude of the second electrical signal when acceptable coins of the single value are passed between the pair of spaced apart coils 20, 22. After the coin acceptance mechanism 10 has been programmed, a coin can be passed between the pair of coils 20, 22 and the phase difference between the first and second signals in the pair of coils 20,22 can be sensed along with the peak amplitude of the second signal to determine whether the coin is an acceptable coin.

What I claim is:

1. A coin acceptance mechanism comprising a coin receiving chute having a pair of sides between which coins are adapted to pass, first and second spaced apart coils located on opposite sides of said coin chute in a location in which a coin received in said chute passes between said first and second spaced apart coils when the coin is received in said coin chute, a signal generator for generating a first electrical signal and directing said first signal to said first coil, said first coil inducing a second signal in said second coil which second signal changes in phase and amplitude when a coin passes between said first and second coils, means for determining the phase difference between said first and second signals when a coin passes between said first and second coils and establishing a third signal indicative of said phase difference, means for determining the peak amplitude of said second signal when a coin passes between said first and second coils and establishing a fourth signal indicative of said peak amplitude of said second signal, memory means having stored therein a range of acceptable values for the peak phase difference between said first and second signals and the peak amplitude of said second signal which are indicative of an acceptable coin passing between said first and second coils, microprocessor means for receiving said third signal, said fourth signal and determining the peak phase difference between said first and second signals and the peak amplitude of said second signal, said microprocessor being operatively connected to said memory means for comparing said third and fourth signals with said range of acceptable values in said memory means to determine if a coin passing between said coils is an acceptable coin and for assigning a credit value for coins which are determined to be acceptable, said microprocessor means having a learning mode in which a plurality of sample acceptable coins of a predetermined value are sequentially placed in said coin chute and the plurality of third and fourth signals established in response to said plurality of sample acceptable coins are averaged to determine an acceptable range of values for each of said third and fourth signals which represent an acceptable coin, said microprocessor means storing said acceptable range of values for said third and fourth signals in said memory means.

2. A coin acceptance mechanism as defined in claim 1 further including a coin box, a coin return chute, and a solenoid mechanism for directing acceptable coins from said coin chute to said coin box and for directing unacceptable coins from said coin chute to said coin return chute.

3. A coin acceptance mechanism as defined in claim 2 further including a sensor located between said coin box and said solenoid mechanism for sensing the passing of a coin from said coin chute to said coin box and establishing a coin received signal in response thereto and sending said coin received signal to said microprocessor means when a coin passes said sensor, said microprocessor means generating a credit output indicating the receipt and value of an acceptable coin in said coin box when said sensor sends said coin received signal to said microprocessor means.

4. A coin acceptance mechanism as defined in claim 3 wherein said signal generator is an oscillator.

5. A coin acceptance mechanism as defined in claim 4 wherein said means for determining the phase difference between said first and second signals when a coin passes between said first and second coils includes means for sensing the phase of said first signal at said first coil and establishing an output indicative of said phase, means for sensing the phase of said second signal at said second coil and establishing an output indicative of said phase, means for comparing the output of said means for sensing the phase of said first signal and the output of said means for sensing the phase of said second signal and establishing said third signal which is an analog pulse having a duration which is indicative of the difference in phase between said first signal and said second signal and directing said third signal to said microprocessor means.

6. A coin acceptance mechanism as defined in claim 1 wherein said memory means stores a plurality of ranges of acceptable values for the peak phase difference between said first and second signals and the peak amplitude of said second signal and wherein each of said plurality of acceptable ranges represent an acceptable range for acceptable coins having a single predetermined value and each of the plurality of acceptable ranges is indicative of coins of a different value.

7. A coin acceptance mechanism as defined in claim 1 wherein said microprocessor is operative to compare said third signal and said fourth signal with said range of acceptable values stored in said memory means and determines that a coin is acceptable when the third signal is within a range of acceptable values for the third signal stored in said memory means and the fourth signal is within a range of acceptable values for said fourth signal stored in said memory means.

8. A coin acceptance mechanism as defined in claim 6 wherein said microprocessor is operative to compare said third signal and said fourth signal with said range of acceptable values stored in said memory means and determines that a coin is acceptable when the third signal is within a range of acceptable values for the third signal stored in said memory means and the fourth signal is within a range of acceptable values for said fourth signal stored in said memory means.

9. A method of determining whether a coin which passes between a pair of coils in a coin acceptance mechanism is an acceptable coin and assigning a value to a coin deemed acceptable comprising the steps of:

a) providing a pair of spaced apart coils between which coins must pass when received in the coin acceptance mechanism, b) establishing a first electrical signal in one of said coils which induces a second electrical signal in the other of said coils which second signal changes in phase and amplitude when a coin passes between said pair of spaced apart coils, c) sequentially passing a plurality of sample acceptable coins of a single value between said pair of coils in said coin acceptance mechanism, d) determining the phase difference between said first electrical signal in one of said coils and the second electrical signal induced in the other of said coils when each of said plurality of sample acceptable coins sequentially passes between said pair of coils, e) determining the peak amplitude of said second electrical signal induced in said other coil when each of said plurality of sample acceptable coins sequentially passes between said pair of coils, f) determining the average peak phase difference between said first and second electrical signals for the plurality of sample acceptable coins, g) determining the average peak amplitude of said second electrical signal for the plurality of sample acceptable coins, h) using the determined average peak phase difference to determine a first range of acceptable values for the phase difference between said first and second signals when acceptable coins of said first single value are passed between said pair of spaced apart coils, i) storing said determined range of acceptable values for the phase difference between said first and second signals, j) using the determined average peak amplitude of said second electrical signals to determine a first range of acceptable values for the peak amplitude of said second electrical signal when acceptable coins of said first single value are passed between said pair of spaced apart coils, k) storing said determined range of acceptable values for the peak amplitude of said second electrical signals, l) passing a coin between said pair of coils, m) determining the peak phase difference between said first and second signals when the coin passes between said pair of coils, n) determining the peak amplitude of said second signal when the coin passes between said pair of coils, and o) comparing the determined peak phase difference between said first and second signals and the determined peak amplitude of said second signal with said stored first range of acceptable values for the determined peak phase difference and said stored first range of acceptable values for the peak amplitude of said second signal to determine if the coin is an acceptable coin and to assign a first value to a coin deemed acceptable.

10. A method of determining whether a coin which passes between a pair of coils in a coin acceptance mechanism is an acceptable coin and assigning a value to a coin deemed acceptable as defined in claim 9 further including the steps of:

a) passing a plurality of sample acceptable coins of a second single value which is different from said first value between said pair of coils in the coin acceptance mechanism, b) determining the phase difference between said first electrical signal in one of said coils and said second electrical signal in the other of said coils when each of said plurality of sample acceptable coins of said second single value passes between said pair of coils, c) determining the peak amplitude of said second electrical signal induced in said other coil when each of said plurality of sample acceptable coins of said second single value passes between said pair of coils, d) determining the average peak phase difference between said first and second electrical signals for the plurality of sample acceptable coins of said second single value, e) determining the average peak amplitude of said second electrical signal for the plurality of sample acceptable coins of said second single value, f) using the determined average peak phase difference to determine a second range of acceptable values for the peak phase difference between said first and second signals when acceptable coins of said single second value are passed between said pair of spaced apart coils, g) storing said determined second range of acceptable values for the peak phase difference for coins of said second value, h) using the determined average peak amplitude of said second electrical signals to determine a second range of acceptable values for the peak amplitude of said second electrical signal when acceptable coins of said single second value are passed between said pair of spaced apart coils, and i) storing said determined second range of acceptable values for the peak amplitude of said second signal for coins of said second value.

11. A method of determining whether a coin which passes between a pair of coils in a coin acceptance mechanism is an acceptable coin and assigning a value to a coin deemed acceptable as defined in claim 10 wherein said step of comparing said sensed phase difference between said first and second signals and said sensed peak amplitude of said second signal with said determined range of acceptable values for the sensed phase difference and said determined range of acceptable values for the second signal to determine if a coin passing between said pair of coils is an acceptable coin includes the steps of:

a) assigning a first value to a coin deemed acceptable if said peak phase difference and said peak amplitude of said second signal are both within said stored range of first acceptable values for coins of said first value, and b) assigning a second value to a coin deemed acceptable if said peak phase difference between said first and second signals and said sensed peak amplitude of said second signal are both within said stored range of second acceptable values for the sensed peak phase difference and said stored range of second acceptable values for the peak amplitude of said second signal.

12. A method of determining whether a coin which passes between a pair of coils in a coin acceptance mechanism is an acceptable coin and assigning a value to a coin deemed acceptable as defined in claim 11, further including the steps of:

a) directing a coin deemed acceptable to a coin box, and b) directing a coin deemed unacceptable to a coin return chute.

13. A method of determining whether a coin which passes between a pair of coils in a coin acceptance mechanism is an acceptable coin and assigning a value to a coin deemed acceptable as defined in claim 12 further including the steps of:

a) sensing the passage of a coin into the coin box, and b) generating a coin-received signal in response thereto.

14. A method of determining whether a coin which passes between a pair of coils in a coin acceptance mechanism is an acceptable coin and assigning a value to a coin deemed acceptable as defined in claim 9 wherein said step of determining the phase difference between said first electrical signal in one of said coils and said second electrical signal induced in the other of said coils comprises the steps of:

a) sensing the phase of said first electrical signal in said one coil, b) sensing the phase of said second signal induced in said other coil, c) comparing said sensed phase of said first signal with said sensed phase of said second signal, and d) establishing a third signal which is an analog voltage having a value which is indicative of the difference in phase between said first signal and said second signal.

15. A method of determining whether a coin which passes between a pair of coils in a coin acceptance mechanism is an acceptable coin and assigning a value to a coin deemed acceptable as defined in claim 10 further including the steps of:

a) comparing said sensed peak phase difference between said first and second signals with said stored second range of acceptable values for the sensed phase difference; and b) comparing the sensed peak amplitude of said second signal with said stored second range of acceptable values for the second signal to determine if a coin which passes between said pair of coils is an acceptable coin of said second value.

16. A method of determining whether a coin which passes between a pair of coils in a coin acceptance mechanism is an acceptable coin and assigning a value to a coin deemed acceptable as defined in claim 15 wherein said step of using the determined average peak phase difference to determine a first range of acceptable values for peak phase difference between said first and second signals includes the steps of:

a) adding a predetermined value to said determined average peak phase difference to set an upper limit of acceptable values for the peak phase difference between said first and second signals for acceptable coins of a first value; and b) subtracting a predetermined value from said determined average peak phase difference to set a lower limit of acceptable values for the peak phase difference between said first and second signals for acceptable coins of a first value.

17. A method of determining whether a coin which passes between a pair of coils in a coin acceptance mechanism is an acceptable coin and assigning a value to a coin deemed acceptable as defined in claim 16 wherein said step of using the determined average peak amplitude of said second signal to determine a first range of acceptable values for the amplitude of said second signal includes the steps of:

a) adding a predetermined value to said determined average peak amplitude of said second signal to set an upper limit of acceptable values for the peak amplitude of said second signal for acceptable coins of a first value; and b) subtracting a predetermined value from said determined average peak amplitude of said second signal to set a lower limit of acceptable values for the peak amplitude of said second signal for coins of said first value.

18. A method of determining whether a coin which passes between a pair of coils in a coin acceptance mechanism is an acceptable coin and assigning a value to a coin deemed acceptable as defined in claim 16 wherein said step of adding a predetermined value to said determined average peak phase difference includes the steps of:

a) adding a predetermined percentage of said determined average peak phase difference to set an upper limit of acceptable values for the peak phase difference between said first and second signals for coins of said first value; and b) subtracting a predetermined value which is a percentage of the determined average peak phase difference to set a lower limit of acceptable values for the peak phase difference between said first and second signals for acceptable coins of a first value.

19. A method of determining whether a coin which passes between a pair of coils in a coin acceptance mechanism is an acceptable coin and assigning a value to a coin deemed acceptable as defined in claim 18 wherein said step of using the determined average peak amplitude of said second signal to determine a first range of acceptable values for the second signal includes the steps of:

a) adding a predetermined value which is a percentage of the determined average peak amplitude of said second signal to said determined average peak amplitude of said second signal to set an upper limit of acceptable values for said second signal for acceptable coins of a first value;

b) and subtracting a predetermined value which is a percentage of said determined average peak amplitude of said second signal from said determined average value of said second signal to set a lower limit of acceptable values for the peak amplitude of said second signal for acceptable coins of a first value.

* * * * *